US009870857B2

(12) United States Patent
Hirai et al.

(10) Patent No.: US 9,870,857 B2
(45) Date of Patent: Jan. 16, 2018

(54) COMMON-MODE CHOKE COIL

(71) Applicant: MURATA MANUFACTURING CO., LTD., Kyoto (JP)

(72) Inventors: Shinya Hirai, Nagaokakyo (JP); Yuki Kanbe, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/207,328

(22) Filed: Mar. 12, 2014

(65) Prior Publication Data

US 2014/0306789 A1 Oct. 16, 2014

(30) Foreign Application Priority Data

Apr. 15, 2013 (JP) ..... 2013-084878

(51) Int. Cl.

| | |
|---|---|
| ***H01F 27/29*** | (2006.01) |
| ***H01F 27/28*** | (2006.01) |
| ***H01F 17/04*** | (2006.01) |
| ***H01F 27/02*** | (2006.01) |
| ***H01F 27/34*** | (2006.01) |
| *H01F 17/00* | (2006.01) |

(52) U.S. Cl.

CPC ..... *H01F 27/34* (2013.01); *H01F 17/045* (2013.01); *H01F 2017/0093* (2013.01)

(58) Field of Classification Search

CPC .... H01F 17/045; H01F 27/004; H01F 27/006; H01F 27/28; H01F 27/2823; H01F 27/33; H01F 27/34; H01F 27/29; H01F 27/292

USPC ..... 336/188, 180, 220–222, 83, 192

See application file for complete search history.

(56) References Cited

U.S. PATENT DOCUMENTS

| | | | | |
|---|---|---|---|---|
| 6,472,969 | B1 * | 10/2002 | Hanato | 336/192 |
| 6,522,230 | B2 * | 2/2003 | Hanato et al. | 336/83 |
| 6,938,327 | B2 * | 9/2005 | Takayama | H01F 37/00 264/250 |
| 8,686,822 | B2 * | 4/2014 | Huang | H01F 27/292 336/170 |
| 2006/0033603 | A1 * | 2/2006 | Hirai | H01F 17/045 336/200 |
| 2008/0224813 | A1 * | 9/2008 | Hirai | H01F 17/045 336/216 |
| 2010/0148912 | A1 * | 6/2010 | Nakatani | H01F 17/04 336/220 |

FOREIGN PATENT DOCUMENTS

| | | | |
|---|---|---|---|
| DE | 10 2008 053 412 | A1 * | 5/2010 |
| JP | 2003-109836 | A1 * | 4/2003 |

(Continued)

OTHER PUBLICATIONS

An Office Action; "Notification of Reasons for Rejection," issued by the Japanese Patent Office dated Mar. 24, 2015, which corresponds to Japanese Patent Application No. 2013-084878 and is related to U.S. Appl. No. 14/207,328; with English language translation.

(Continued)

*Primary Examiner* — Mangtin Lian

(74) *Attorney, Agent, or Firm* — Studebaker & Brackett PC

(57) ABSTRACT

A common-mode choke coil having: a core that extends in a predetermined direction; and first and second wires that are intertwined and wound together around the core.

9 Claims, 6 Drawing Sheets

(56) References Cited

FOREIGN PATENT DOCUMENTS

| | | | | |
|---|---|---|---|---|
| JP | 2004-260095 | A | | 9/2004 |
| JP | 2005-056934 | A | | 3/2005 |
| JP | 2006-339250 | A | * | 12/2006 |

OTHER PUBLICATIONS

An Office Action; "Decision of Final Rejection," issued by the Japanese Patent Office dated Jun. 30, 2015, which corresponds to Japanese Patent Application No. 2013-084878 and is related to U.S. Appl. No. 14/207,328; with English language translation.

* cited by examiner

COMPARATIVE EXAMPLE

COMPARATIVE EXAMPLE

COMMON-MODE CHOKE COIL

CROSS REFERENCE TO RELATED APPLICATIONS

This application claims benefit of priority to Japanese Patent Application No. 2013-084878 filed on Apr. 15, 2013, the content of which is incorporated herein by reference.

TECHNICAL FIELD

The present invention relates to common-mode choke coils, including, for example, a wire-wound common-mode choke coil.

BACKGROUND

As an invention related to a conventional common-mode choke coil, a common-mode noise filter described in, for example, Japanese Patent Laid-Open Publication No. 2005-56934 is known. The common-mode filter has a first wire wound around a drum core and a second wire wound over the first wire.

However, the common-mode choke coil described in Japanese Patent Laid-Open Publication No. 2005-56934 might not be able to effectively remove common-mode noise. FIG. 4 provides graphs showing the relationship between positions along the first wire and potential and the relationship between positions along the second wire and potential.

Since the common-mode choke coil has the second wire wound over the first wire, the second wire is longer than the first wire. In this case, when differential-mode signals are transmitted through the first and second wires, the potential at one end of the first wire and the potential at one end of the second wire are equal in absolute value, as shown in FIG. 4, but the potential at the other end of the first wire and the potential at the other end of the second wire are not necessarily equal in absolute value. As a result, the differential-mode signals are outputted as common-mode noise.

SUMMARY

A common-mode choke coil according to an embodiment of the present invention includes a core configured to extend in a predetermined direction, and first and second wires configured to be intertwined and to be wound together around the core.

DETAILED DESCRIPTION

Hereinafter, a common-mode choke coil according to an embodiment of the present invention will be described.

Configuration of Common-Mode Choke Coil

Figure 1A:
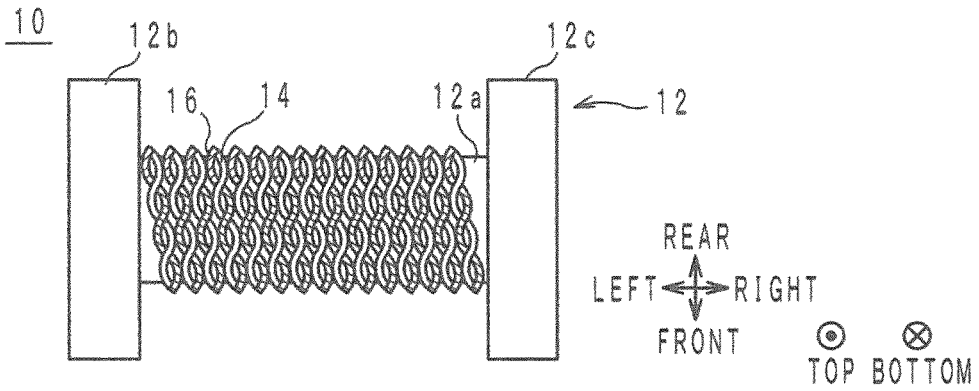
FIG. 1A is a top view of a common-mode choke coil according to an embodiment.
Figure 1B:
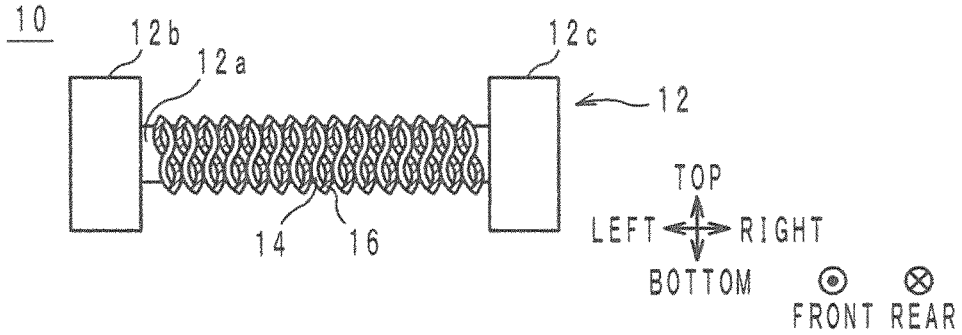
FIG. 1B is a front view of the common-mode choke coil according to the embodiment.
Figure 1C:
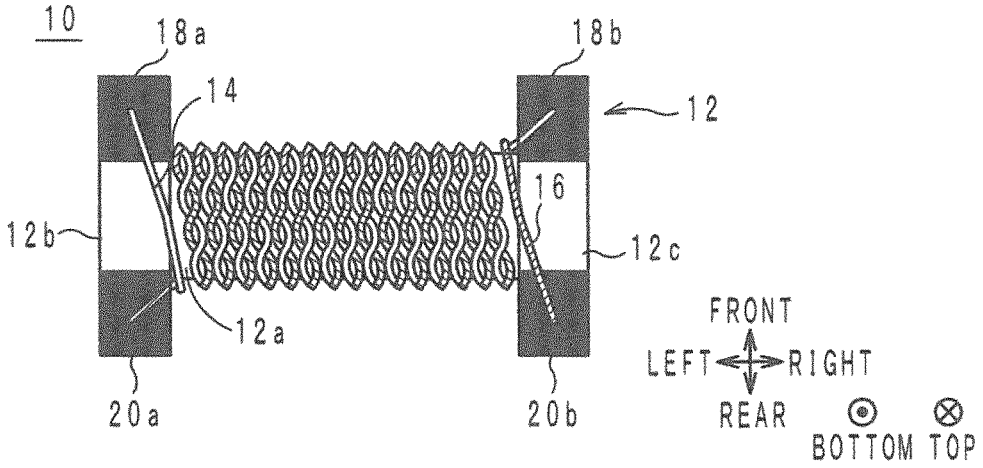
FIG. 1C is a bottom view of the common-mode choke coil according to the embodiment.

The configuration of the common-mode choke coil 10 according to the embodiment will be described below with reference to the drawings. FIG. 1A is a top view of the common-mode choke coil 10 according to the embodiment. FIG. 1B is a front view of the common-mode choke coil 10 according to the embodiment. FIG. 1C is a bottom view of the common-mode choke coil 10 according to the embodiment. In the following, the longitudinal direction of the common-mode choke coil 10 will be defined as the right-left direction, and directions perpendicular to the right-left direction will be defined as the top-bottom direction and the front-rear directions.

The common-mode choke coil 10 includes a core 12, wires 14 and 16, and external electrodes 18*a*, 18*b*, 20*a*, and 20*b*, as shown in FIGS. 1A, 1B, and 1C.

The core 12 is made of a magnetic material (e.g., NiCuZn ferrite), and is in the form of an H when viewed in a top view, a bottom view, a front view, and also a rear view. The core 12 includes a core member 12*a* and flanges 12*b* and 12*c*, as shown in FIGS. 1A, 1B, and 1C.

The core member 12*a* is in the form of a quadrangular prism extending in the right-left direction. However, the core member 12*a* may be in another form such as a column.

The flange 12*b* is in the form of a rectangular solid, and is connected to the left end of the core member 12*a*. The flange 12*b*, when viewed in a left-side view, juts out from the core member 12*a* both in the top-bottom direction and the front-rear direction.

The flange 12*c* is in the form of a rectangular solid, and is connected to the right end of the core member 12*a*. The flange 12*c*, when viewed in a right-side view, juts out from the core member 12*a* both in the top-bottom direction and the front-rear direction.

The external electrode 18*a* is provided in the form of a rectangle and positioned on the front side at the bottom of the flange 12*b* relative to the center in the front-rear direction. The external electrode 18*a* is formed by an electrode base made of Ag being plated with Ni and Sn.

The external electrode 18*b* is provided in the form of a rectangle and positioned on the front side at the bottom of the flange 12*c* relative to the center in the front-rear direction. The external electrode 18*b* is formed by an electrode base made of Ag being plated with Ni and Sn.

The external electrode 20*a* is provided in the form of a rectangle and positioned on the rear side at the bottom of the flange 12*b* relative to the center in the front-rear direction. The external electrode 20*a* is formed by an electrode base made of Ag being plated with Ni and Sn.

The external electrode 20*b* is provided in the form of a rectangle and positioned on the rear side at the bottom of the flange 12*c* relative to the center in the front-rear direction. The external electrode 20*b* is formed by an electrode base made of Ag being plated with Ni and Sn.

The wires 14 and 16 are intertwined and wound together around the core member 12*a* of the core 12. Moreover, the wires 14 and 16 are helically wound in the same direction.

Furthermore, both ends of the wire 14 are led out from the core member 12*a*. The left end of the wire 14 is connected to the external electrode 18*a*. The right end of the wire 14 is connected to the external electrode 18*b*.

Furthermore, both ends of the wire 16 are led out from the core member 12*a*. The left end of the wire 16 is connected to the external electrode 20*a*. The right end of the wire 16 is connected to the external electrode 20*b*.

In the common-mode choke coil 10 thus configured, the wires 14 and 16 overlap with each other when viewed in a right-side view. Accordingly, magnetic flux produced by the wire 14 passes through a space surrounded by the wire 16, and magnetic flux produced by the wire 16 passes through a space surrounded by the wire 14. Therefore, the wires 14 and 16 are magnetically coupled to each other, so that the common-mode choke coil is created by the wires 14 and 16. Moreover, for example, the external electrodes 18*a* and 20*a* are used as input terminals, and the external electrodes 18*b* and, 20*b* are used as output terminals. That is, differential-mode signals are inputted to the external electrodes 18*a* and 20*a*, and outputted from the external electrodes 18*b* and 20*b*. In the case where the differential-mode signals contain common-mode noise, the common-mode noise causes the wires 14 and 16 to produce magnetic flux in the same direction. Therefore, the magnetic flux is intensified, resulting in impedance against common-mode components, so that common-mode noise is prevented from passing through the wires 14 and 16.

Method for Producing Coil Components

Next, the method for producing the common-mode choke coil 10 will be described with reference to the drawings.

First, powder mainly composed of ferrite from which to make a core 12 is prepared. Then, the prepared ferrite powder is provided in a female die. The provided powder is compacted by a male die, thereby shaping a core member 12*a* and flanges 12*b* and 12*c*. Further, the core 12 is sintered. As a result, the core 12 is completed.

Next, external electrodes 18*a*, 18*b*, 20*a*, and 20*b* are formed on the bottoms of the flanges 12*b* and 12*c* of the core 12. More specifically, the bottoms of the flanges 12*b* and 12*c* are immersed in a container filled with an Ag paste so as to cause the Ag paste to adhere to the bottoms. Then, the adhered Ag paste is dried and sintered, thereby forming electrode bases on the bottoms of the flanges 12*b* and 12*c*. Further, Ni alloy-based metal films and Sn alloy-based metal films are formed on the electrode bases by electroplating or suchlike. As a result, the external electrodes 18*a*, 18*b*, 20*a*, and 20*b* are formed.

Next, wires 14 and 16 are wound around the core member 12*a* of the core 12. More specifically, the wires 14 and 16 are intertwined into one. Thereafter, the intertwined wires 14 and 16 are wound around the core member 12*a*. At this time, both ends of each of the wires 14 and 16 are led out from the core member 12*a* by a predetermined length.

Lastly, the led-out portions of the wires 14 and 16 are connected to the external electrodes 18*a*, 18*b*, 20*a*, and 20*b* by thermocompression bonding. Through the above process, the common-mode choke coil 10 is completed.

Effects

Figure 2:
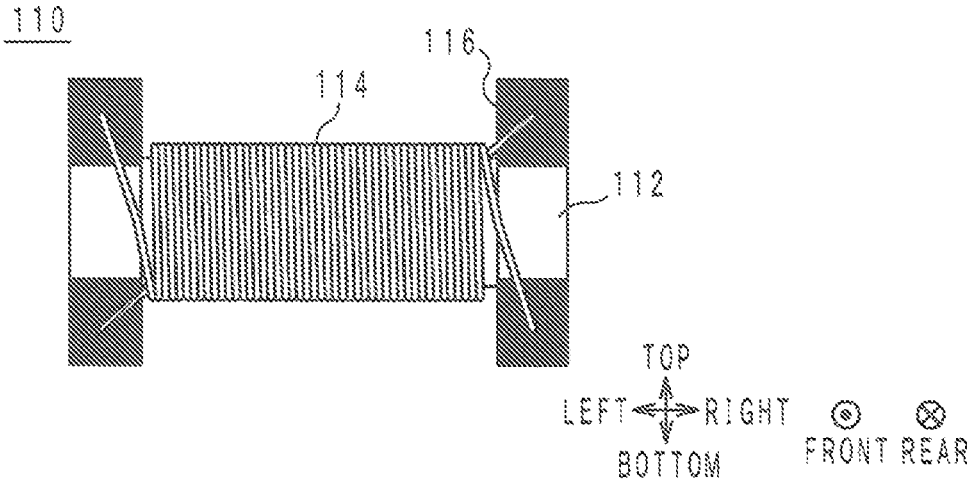
FIG. 2 is a bottom view of a common-mode choke coil according to a comparative example.
Figure 3:
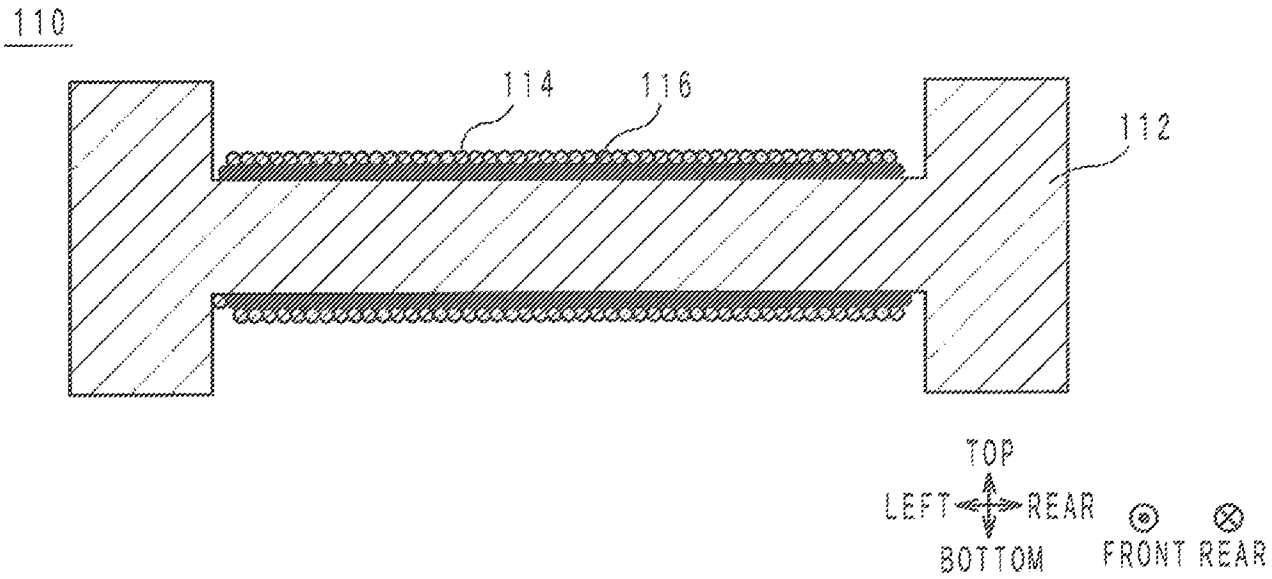
FIG. 3 is a cross-sectional structure view of the common-mode choke coil according to the comparative example.
Figure 4:
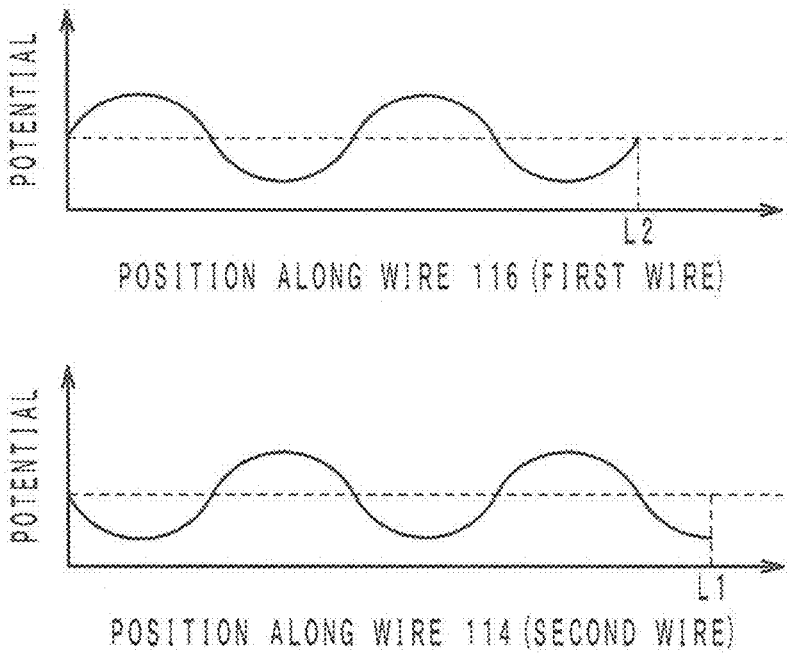
FIG. 4 provides graphs showing the potentials of wires upon input of differential mode signals to the common-mode choke coil.

The common-mode choke coil 10 thus configured renders it possible to effectively remove common-mode noise. FIG. 2 is a bottom view of a common-mode choke coil 110 according to a comparative example. FIG. 3 is a cross-sectional structure view of the common-mode choke coil 110 according to the comparative example. FIG. 4 provides graphs showing the potentials of wires 114 and 116 upon input of differential-mode signals to the common-mode choke coil 110.

The common-mode choke coil 110 includes a core 112 and the wires 114 and 116. The wire 116 is wound around the core 112, and the wire 114 is wound over the wire 116.

In the common-mode choke coil 110 according to the comparative example, the length L1 of the wire 114 is longer than the length L2 of the wire 116. In this case, when differential-mode signals are transmitted through the wires 114 and 116, the potential at the left end of the wire 114 and the potential at the left end of the wire 116 are equal in absolute value, as shown in FIG. 4, but the potential at the right end of the wire 114 and the potential at the right end of the wire 116 are not necessarily equal in absolute value. As a result, the differential-mode signals are outputted as common-mode noise.

On the other hand, in the case of the common-mode choke coil 10, the wires 14 and 16 are intertwined and wound together around the core member 12*a* of the core 12. Accordingly, the wires 14 and 16 are approximately equal in winding radius. As a result, the wires 14 and 16 are also approximately equal in length. Therefore, when differential-mode signals are transmitted through the wires 14 and 16, the potential at the left end of the wire 14 and the potential at the left end of the wire 16 are equal in absolute value at each time point, and the potential at the right end of the wire 14 and the potential at the right end of the wire 16 are also equal in absolute value at each time point. Consequently, the differential-mode signals are inhibited from being outputted as common-mode noise. Thus, the common-mode choke coil 10 renders it possible to effectively remove common-mode noise.

To better clarify the effects achieved by the common-mode choke coil, the present inventors carried out experimentation as described below. Initially, a common-mode choke coil 110 as shown in FIGS. 2 and 3 was made as a first sample, and a common-mode choke coil 10 as shown in FIGS. 1A, 1B, and 1C was made as a second sample. Note that the details of the first and second samples are as follows:

Size: 4.5 mm×3.2 mm×2.6 mm

Number of turns: 46

Wire diameter: 0.04 mm

Figure 5:
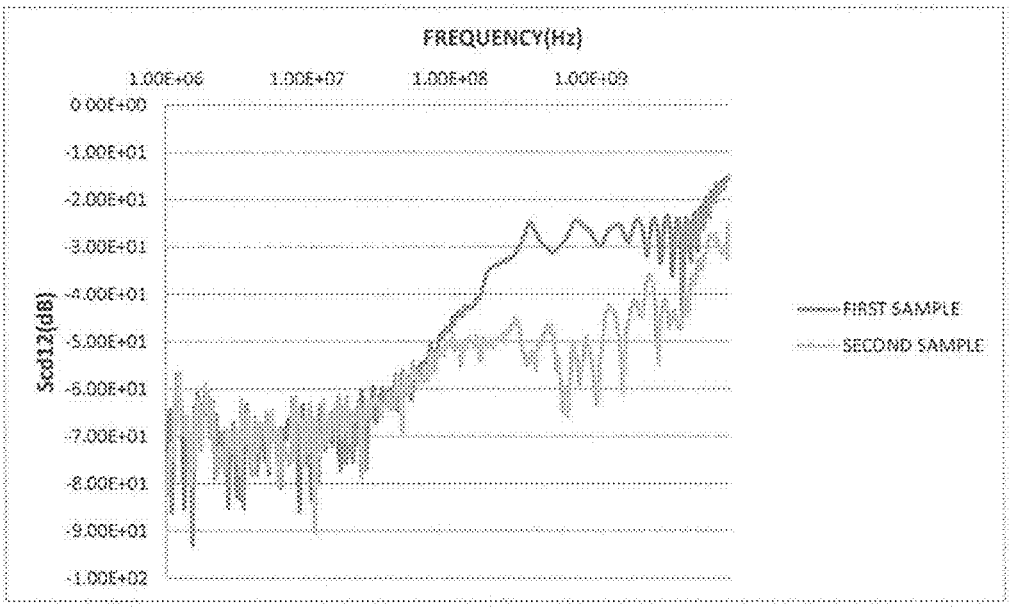
FIG. 5 is a graph showing the relationship between frequency and Scd12.
Figure 6:
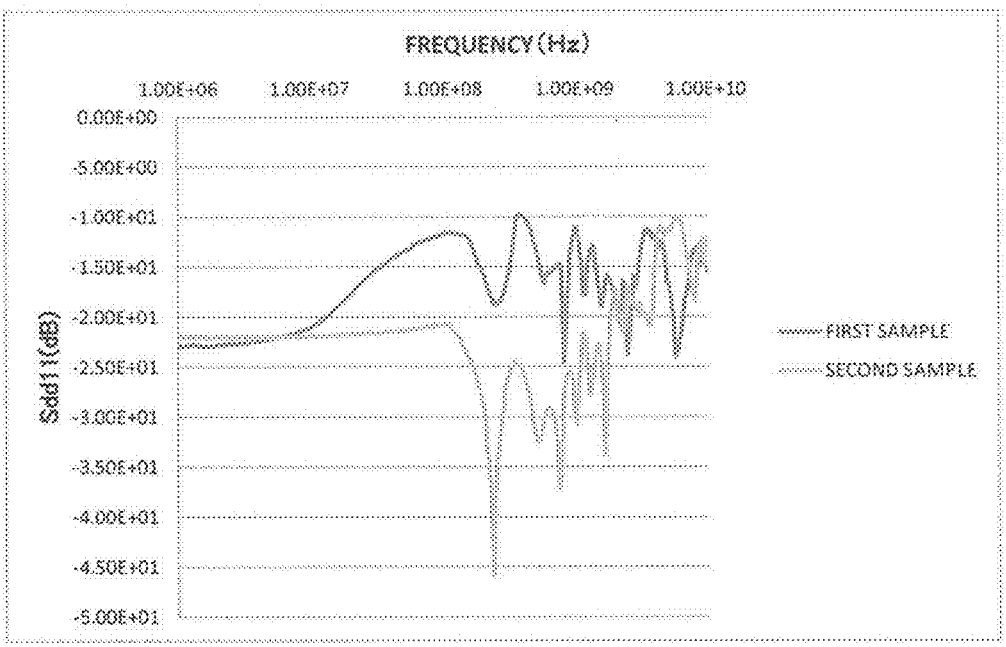
FIG. 6 is a graph showing the relationship between frequency and Sdd11.

S-parameters of the first and second samples as above were measured. More specifically, Scd 12 and Sdd 11 were calculated for each of the first and second samples. Scd 12 is a parameter that indicates the value of the intensity ratio of a common-mode signal outputted from the external electrode 18*a* to a differential-mode signal inputted to the external electrode 18*b*. That is, Scd 12 indicates the proportion of the differential-mode signal converted into the common-mode signal. Sdd 11 is a parameter that indicates the value of the intensity ratio of a differential-mode signal outputted from the external electrode 18*a* to a differential-mode signal inputted to the external electrode 18*a*. That is, Sdd 11 indicates the amount of reflection of the differential-mode signal. FIG. 5 is a graph showing the relationship between frequency and Scd 12. The vertical axis represents Scd 12, and the horizontal axis represents the frequency. FIG. 6 is a graph showing the relationship between frequency and Sdd 11. The vertical axis represents Sdd 11, and the horizontal axis represents the frequency.

It can be appreciated that the value of Scd 12 was smaller for the second sample than for the first sample, as shown in FIG. 5. Accordingly, it can be appreciated that the proportion of the differential-mode signal converted into the common-mode signal was lower for the second sample than for the first sample. That is, it can be appreciated that common-mode noise was removed more effectively in the common-mode choke coil 10 than in the common-mode choke coil 110.

Furthermore, it can be appreciated that the value of Sdd 11 was smaller for the second sample than for the first sample, as shown in FIG. 6. Accordingly, it can be appreciated that the amount of reflection of the differential-mode signal was lower for the second sample than for the first sample. The reason for this will be described below. As the value of Scd 12 decreases for the above reason, the value of Sdc 12 decreases as well for the same reason. Here, Sdc 12 is a parameter that indicates the value of the intensity ratio of a differential-mode signal outputted from the external electrode 18*a* to a common-mode signal inputted to the external electrode 18*b*. More specifically, the value of the intensity ratio of a differential-mode signal outputted from the external electrode 18*a* to a common-mode signal inputted to the external electrode 18*b* decreases. As a result, the intensity of the differential-mode signal outputted from the external electrode 18*a* decreases. Therefore, the value of the intensity ratio of the differential-mode signal outputted from the external electrode 18*a* to the differential-mode signal inputted to the external electrode 18*b* (i.e., Sdd 11) decreases as well. Thus, the amount of reflection of the differential-mode signal is lower for the second sample than for the first sample.

Other Embodiments

The present invention is not limited to the common-mode choke coil 10, and variations can be made within the spirit and scope of the invention.

Although the present invention has been described in connection with the preferred embodiment above, it is to be noted that various changes and modifications are possible to those who are skilled in the art. Such changes and modifications are to be understood as being within the scope of the invention.

What is claimed is:

1. A common-mode choke coil comprising:

a core configured to extend in a predetermined direction;

first and second wires intertwined and wound together around the core, wherein the first wire is only one wire and the second wire is only one wire;

first and second external electrodes provided at both ends of the core so as to be arranged in the predetermined direction; and third and fourth external electrodes provided at the both ends of the core so as to be separated from the first and second external electrodes, respectively, in a first direction perpendicular to the predetermined direction, wherein:

in a plan view from a second direction perpendicular to both the predetermined direction and the first direction, a first end portion of the first wire is untwisted from a first end portion of the second wire at a first corner of the core;

the first end portion of the first wire and the first end portion of the second wire are connected to the first external electrode and the third external electrode, respectively;

in the plan view from the second direction, a second end portion of the first wire is untwisted from a second portion of the second wire at a second corner of the core diagonal to the first corner;

the second end portion of the first wire and the second end portion of the second wire are connected to the second external electrode and the fourth external electrode, respectively; and at least a part of the first wire of the intertwined and wound first and second wires makes contact with at least a part of the second wire of an adjacent segment of the intertwined and wound first and second wires.

2. The common-mode choke coil according to claim 1, wherein the first and second wires are intertwined and wound together around the core with a gap between at least a part of each of the intertwined and wound first and second wires.

3. The common-mode choke coil according to claim 1, wherein the first wire and the second wire are intertwined and wound together around the core along an entire length of the core between the first corner and the second corner.

4. The common-mode choke coil according to claim 1, wherein differential-mode signals are inputted to the first and third external electrodes and outputted from the second and fourth external electrodes, wherein, when the differential-mode signals contain common-mode noise, the common-mode noise causes the first and second wires to produce magnetic flux in a same direction, and wherein the magnetic flux is intensified resulting in impedance against common-mode components, so that common-mode noise is prevented from passing through the first and second wires.

5. The common-mode choke coil according to claim 1, wherein the contact with the adjacent segment repeats in regular intervals along a length of the intertwined and wound first and second wires.

6. A common-mode choke coil comprising:

a core configured to extend in a predetermined direction;

first and second wires intertwined and wound together around the core, wherein at least a part of the intertwined and wound first and second wires makes contact with an adjacent segment of the intertwined and wound first and second wires with a gap between the intertwined and wound first and second wires and the adjacent segment of the intertwined and wound first and second wires, and wherein the first wire is only one wire and the second wire is only one wire;

first and second external electrodes provided at both ends of the core so as to be arranged in the predetermined direction; and third and fourth external electrodes provided at the both ends of the core so as to be separated from the first and second external electrodes, respectively, in a first direction perpendicular to the predetermined direction, wherein:

in a plan view from a second direction perpendicular to both the predetermined direction and the first direction, a first end portion of the first wire is untwisted from a first end portion of the second wire at a first corner of the core;

the first end portion of the first wire and the first end portion of the second wire are connected to the first external electrode and the third external electrode, respectively;

in the plan view from the second direction, a second end portion of the first wire is untwisted from a second portion of the second wire at a second corner of the core diagonal to the first corner;

the second end portion of the first wire and the second end portion of the second wire are connected to the second external electrode and the fourth external electrode, respectively; and at least a part of the first wire of the intertwined and wound first and second wires makes contact with at least a part of the second wire of an adjacent segment of the intertwined and wound first and second wires.

7. The common-mode choke coil according to claim 6, wherein the first wire and the second wire are intertwined and wound together around the core along an entire length of the core between the first corner and the second corner.

8. The common-mode choke coil according to claim 6, wherein differential-mode signals are inputted to the first and third external electrodes and outputted from the second and fourth external electrodes, wherein, when the differential-mode signals contain common-mode noise, the common-mode noise causes the first and second wires to produce magnetic flux in a same direction, and wherein the magnetic flux is intensified resulting in impedance against common-mode components, so that common-mode noise is prevented from passing through the first and second wires.

9. The common-mode choke coil according to claim 6, wherein the gap and the contact with the adjacent segment repeat in regular intervals along a length of the intertwined and wound first and second wires.

* * * * *